US011596848B1

(12) United States Patent
Raitz

(10) Patent No.: US 11,596,848 B1
(45) Date of Patent: Mar. 7, 2023

(54) TRAINING DEVICE FOR WEDGE SHOTS AND METHOD OF USING SAME

(71) Applicant: G & R Golf, LLC, Lakewood Ranch, FL (US)

(72) Inventor: Matthew Raitz, Lakewood Ranch, FL (US)

(73) Assignee: G & R GOLF, LLC, Lakewood Ranch, FL (US)

( * ) Notice: Subject to any disclaimer, the term of this patent is extended or adjusted under 35 U.S.C. 154(b) by 0 days.

(21) Appl. No.: 17/520,470

(22) Filed: Nov. 5, 2021

(51) Int. Cl.
*A63B 69/36* (2006.01)
*A63B 71/06* (2006.01)

(52) U.S. Cl.
CPC ..... *A63B 69/3623* (2013.01); *A63B 71/06* (2013.01); *A63B 2071/0694* (2013.01); *A63B 2214/00* (2020.08)

(58) Field of Classification Search
CPC ..... A63B 69/36; A63B 69/00; A63B 69/3623
See application file for complete search history.

(56) References Cited

U.S. PATENT DOCUMENTS 3,589,034 A * 6/1971 Beecham ..... A63H 33/3088 428/542.6
4,023,810 A 5/1977 Lorang
4,164,352 A 8/1979 O'Brien
4,355,809 A 10/1982 Swett, Jr.
5,282,627 A * 2/1994 Beck ..... A63B 69/36211 473/260
6,346,050 B1 2/2002 Larson
6,371,863 B1 4/2002 Moran
6,500,075 B1 12/2002 McDevitt
6,746,340 B1 * 6/2004 Dover ..... A63B 69/3661 473/278
7,491,132 B2 2/2009 Bush, III et al.
7,575,522 B1 8/2009 Affrunti
8,475,290 B2 7/2013 Yu et al.
2006/0141434 A1 6/2006 Moran Jr.
2007/0087856 A1 4/2007 Rodriguez et al.
2018/0243628 A1 * 8/2018 Sosin ..... A63B 59/60

* cited by examiner

*Primary Examiner* — Eugene L Kim
*Assistant Examiner* — Christopher Glenn
(74) *Attorney, Agent, or Firm* — Mauriel Kapouytian Woods LLP; Tzvi Hirshaut; Michael Mauriel

(57) ABSTRACT

A training device to practice wedge shots on a golf course and a method of using the training device are described. The training device includes a base with one or more retaining elements to releasably retain a head of the wedge while the wedge shaft is angled backward and thereby demonstrate an approximate optimal angle at which a user should hold the wedge when practicing the wedge shot. A user places the device on a surface, like a sand trap or rough, and inserts the wedge so that the head is retained by the retaining elements while the shaft in angled backward. The user stands on one side of the device, removes the wedge from the retaining elements, shifts the wedge to an opposite side of the device while maintaining the demonstrated angled alignment of the shaft, and initiates a golf swing to hit the ball back onto the green.

13 Claims, 3 Drawing Sheets

FIG. 5
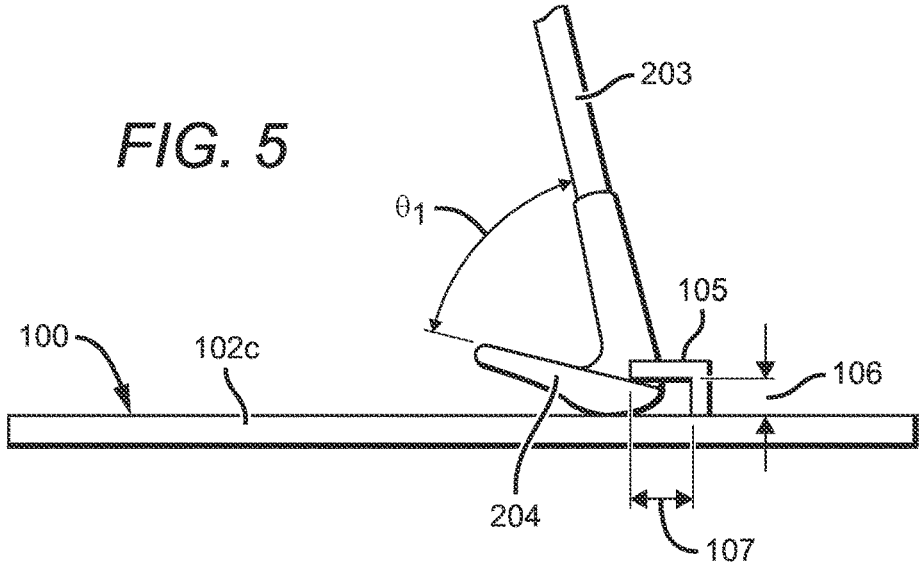
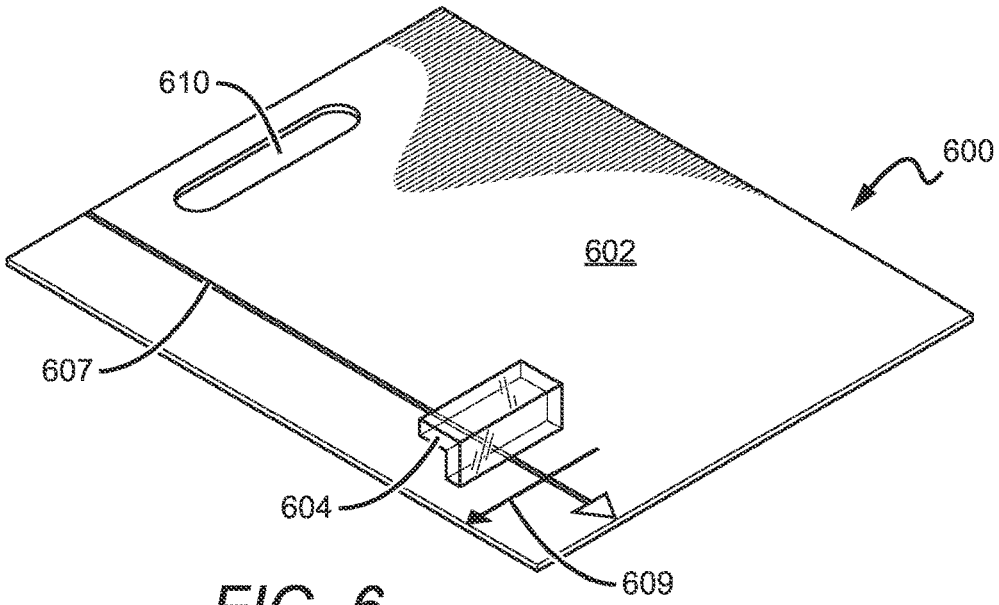
FIG. 6
FIG. 7
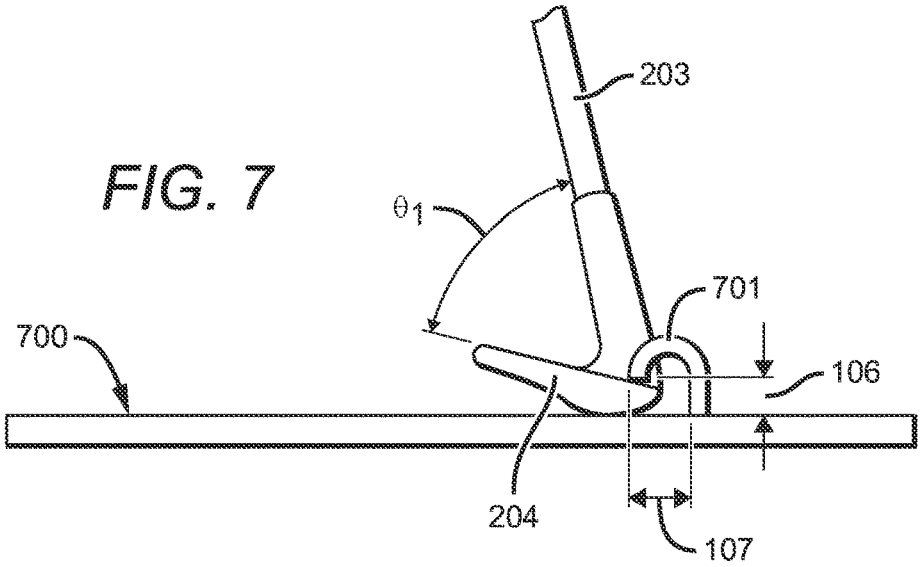

TRAINING DEVICE FOR WEDGE SHOTS AND METHOD OF USING SAME

TECHNICAL FIELD

This invention relates to a training device to train a user to correctly address wedge shots.

BACKGROUND

A particularly challenging shot for golfers (referred to as users herein) is a short-range (e.g., greenside) wedge shot from a bunker or deep grass. A wedge shot is a shot in which a user uses a golf club that has a head with a wedge shape. Such a golf club is often referred to as a golf wedge club or just "a wedge" and is designed to make the golf ball rise steeply and land relatively "softly" (meaning with limited run after landing). For example, when a golf ball lands in a sand trap, i.e., a bunker filled with sand, a sand wedge may be used for a sand shot to hit the golf ball upward and out of the sand trap onto the putting surface, i.e., the "green." As another example, a golf ball may land in rough, i.e., thick grass and/or possibly other vegetation near a green. A wedge may be used for a flop shot to hit the ball onto the green. There are various types of wedges. These include a sand wedge, lob wedge, and gap wedge.

Short-range sand shots and flop shots take a good deal of practice to master. These shots are different than other golf shots. In other golf shots, the club should generally strike the ball first, before hitting the ground. However, in a greenside bunker shot or greenside flop shot, the club should hit the sand (or, in the case of a flop shot, the grass) first. In a greenside bunker shot, for example, the club generally should not directly contact the ball at all, but instead should splash through the sand such that a cushion of moving sand lifts the ball out of the bunker. However, it is important that the club splash through the sand without digging in too deeply (which slows the club excessively) or without skimming the surface too lightly (which risks the club striking the ball directly).

SUMMARY

The present invention recognizes that properly positioning oneself with a golf club relative to a golf ball while getting ready to hit a golf shot (this setup position is known as "addressing" the ball) is important for executing successful golf shots. Moreover, the present invention recognizes that an optimal setup for effectively executing certain wedge shots, particularly a greenside bunker shot or flop shot, involves a different shaft angle and hand position relative to the ball than do other golf shots. In particular, for most golf shots, the user addresses the ball with the hands aligned with, or even slightly forward of the ball, relative to the target. However, embodiments of the present invention provide a training device to help the user learn to address the ball for bunker shots or sand shots with the hands and the club shaft angled slightly behind the ball relative to the target.

BRIEF DESCRIPTION OF THE DRAWINGS

Exemplary embodiments of the present invention will be described with reference to the accompanying figures, wherein:

FIG. 5 is a view of the side of the training device next to which the golf ball is placed with a head of the golf wedge club retained therein in an L-shaped structure as shown in FIG. 2;

FIG. 6 is perspective view of a training device in accordance with another embodiment of the present invention; and FIG. 7 is a right side view of the training device with a head of the golf wedge club retained therein in a J-shaped structure in accordance with another embodiment of the present invention.

DETAILED DESCRIPTION

Figure 2:
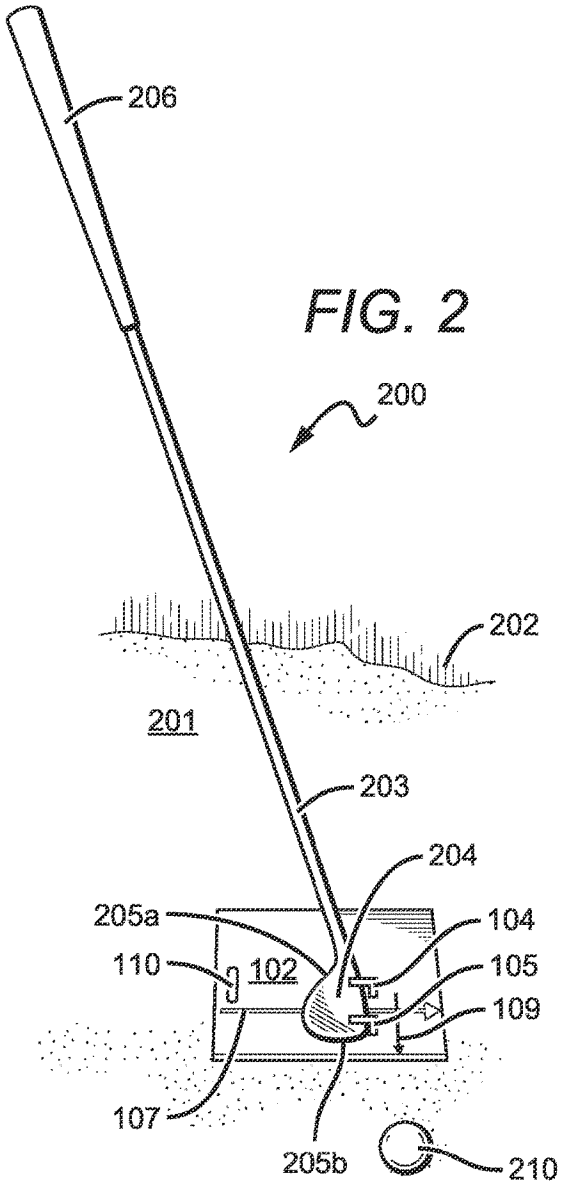
FIG. 2 is a perspective view of the training device of FIG. 1 laid on a surface with a golf wedge club retained in the training in accordance with an embodiment of the present invention.

The present invention includes both a training device that may be used by a user to practice wedge shots and a method of using the training device. The training device allows a user to practice addressing a golf ball that is placed adjacent to the training device with a wedge, using one or more specific types of wedge shots. The wedge used with the training device may be any wedge. However, in embodiments, the wedge is one of a sand wedge, lob wedge, or a gap wedge.

Particular embodiments of the training device include a base having a front and a back and one or more retaining elements on an upper surface of the base. The one or more retaining elements are configured to releasably retain a head of a golf wedge club, referred to herein as a wedge, in a first position such that a shaft of the wedge is tilted back from a vertical position with an angled alignment toward the back of the base. The angled alignment demonstrates to the user an approximate optimal angle at which the user should hold the wedge when initiating a golf swing for one or more specific types of wedge shots. The one or more retaining elements enable removal of the wedge from the one or more retaining elements to allow the user to practice addressing the golf ball adjacent to the base of the training device while attempting to maintain the angled alignment of the shaft of the wedge. The one or more retaining elements may be located away from a centerline of the base.

In embodiments, the one or more retaining elements are on an upper surface of the base and are configured to releasably retain the head of the wedge while maintaining a sole of the wedge in contact with the base. The one or more retaining elements may be configured to retain the head of the wedge such that the shaft of the wedge is at an angle of between 10 to 45 degrees leaning backward from a vertical position.

The training device may also include one or more indicia on or coupled to the upper surface of the base that are configured to guide the user to position the training device toward a target location on the golf course. The one or more indicia may be a line drawn on the top of the base. In embodiments, the one or more retaining elements include at least two retaining elements, and the line is drawn between the at least two retaining elements. Where there are at least two retaining elements, they may be positioned along a direction from one to the other that is transverse to a desired direction of a practice golf swing.

The one or more retaining elements may include one or more L-shaped structures formed with or mounted to the top of the base of the training device. A vertical distance between the base of the training device and an underside of a portion of the one or more L-shaped structures that extend substantially parallel to the base may be between approximately 0.5 and 0.8 inches or may be approximately ⅝ of an inch. In some embodiments, the one or more retaining elements may include one or more J-shaped structures.

The training device may be configured for use in one or more environments. Thus, in embodiments, the one or more retaining elements of the training device may be configured to retain the head of one of a sand wedge, a lob wedge, or a gap wedge. In embodiments, the base of the training device may be configured to be laid in a sand trap and the training device may be used for practicing a sand wedge shot from a sand trap. Alternatively, or in addition, the base of the training device may be configured to be laid in rough near a green and the training device may be used for practicing a flop shot from the rough.

The base of the training device may be formed from at least one of a metal sheet, plastic, or rubber, and may be substantially square-shaped or have some other shape.

A method in accordance with an embodiment of the present invention uses the training device for training a user to correctly address a golf ball for one or more particular types of wedge shots. The method includes placing the training device on a surface, positioning the head of the wedge in the first position to be retained by the one or more retaining elements such that the shaft of the wedge is tilted back in the angled alignment toward the back of the base, removing, by the user, of the wedge from the training device while the user is positioned in proximity to a first side of the base, shifting, by the user, of the wedge from above the training device to a second position behind the golf ball, which is positioned in proximity to a second side of the base opposite the first side of the base, while attempting to maintain the same angled alignment of the shaft of the wedge as was achieved when the head of the wedge was retained by the one or more retaining elements, and initiating, by the user, of the golf swing to address the golf ball with one of the one or more specific types of wedge shots from the second position.

The step of initiating of the golf swing to address the golf ball may include positioning the golf ball to address the golf ball for the one or more specific types of wedge shots.

Where the training device includes one or more first indicia on or coupled to the upper surface of the base that are configured to guide the user to position the training device toward a target location on the golf course, the step of initiating of the golf swing may include initiating of the golf swing in a direction based on the one or more first indicia.

In embodiments, the step of placing the training device on a surface includes laying the base of the training device in a sand trap and wherein the one or more specific wedge shots is a sand wedge shot from a sand trap.

In embodiments, the step of placing the training device on a surface includes laying the base of the training device in rough near a green and wherein the one or more specific wedge shots is a flop shot from the rough.

In embodiments, the method may be practiced with one or more of a sand wedge, a lob wedge, or a gap wedge.

Figure 1:
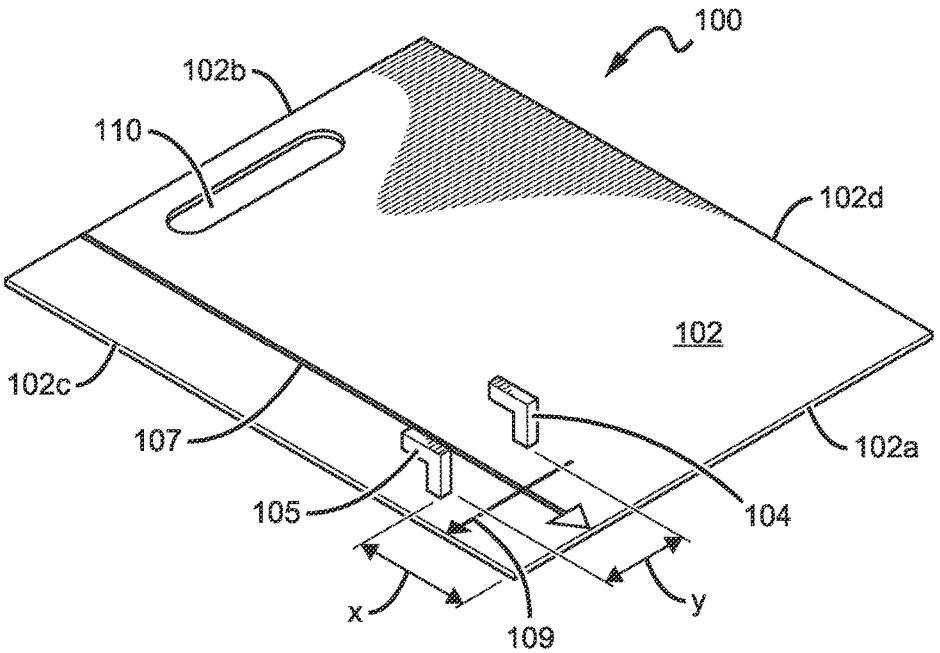
FIG. 1 is a perspective view of a training device in accordance with an embodiment of the present invention.

FIG. 1 is a perspective view of an exemplary training device 100 in accordance with embodiments of the present invention. The illustrated training device 100 is for use by a right-handed golfer. A similar training device for a left-handed golfer is the mirror image of training device 100.

Figure 4:
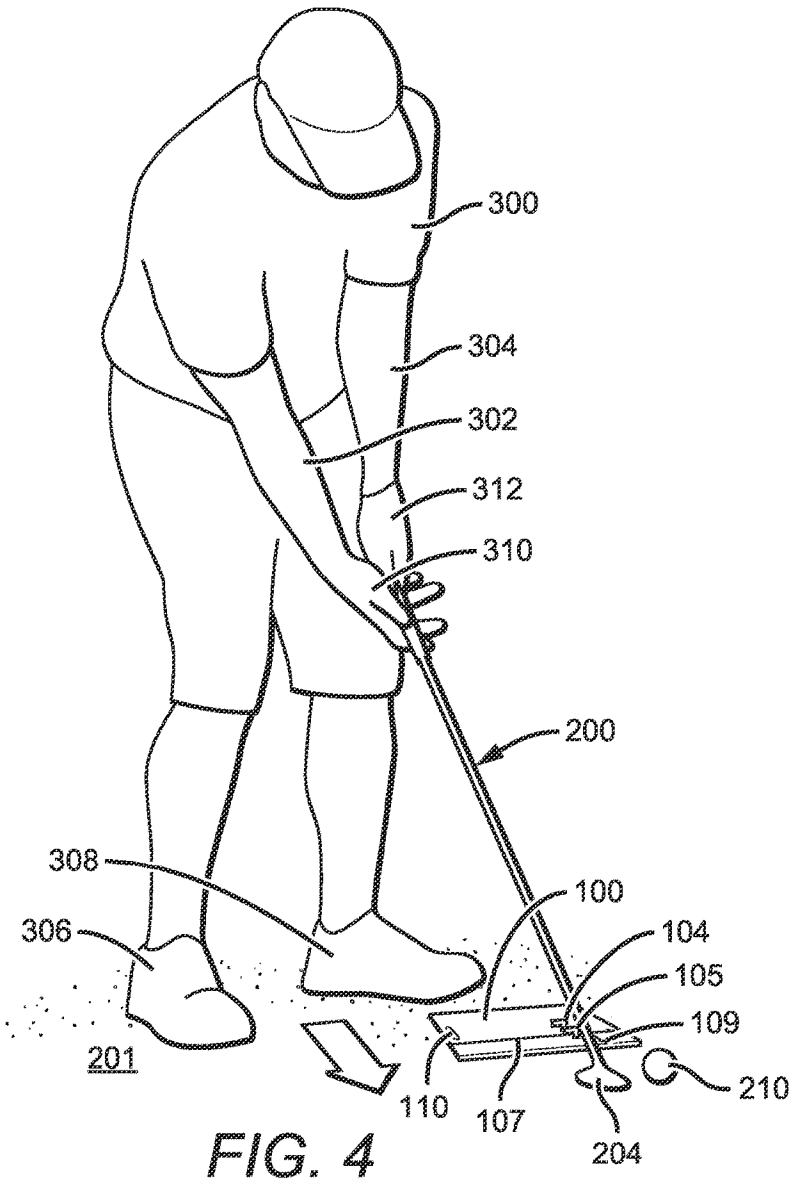
FIG. 4 is a perspective view of the user holding the golf wedge club and maintaining the angled alignment after the golf club is removed from the training device in accordance with an embodiment of the present invention.
Figure 3:
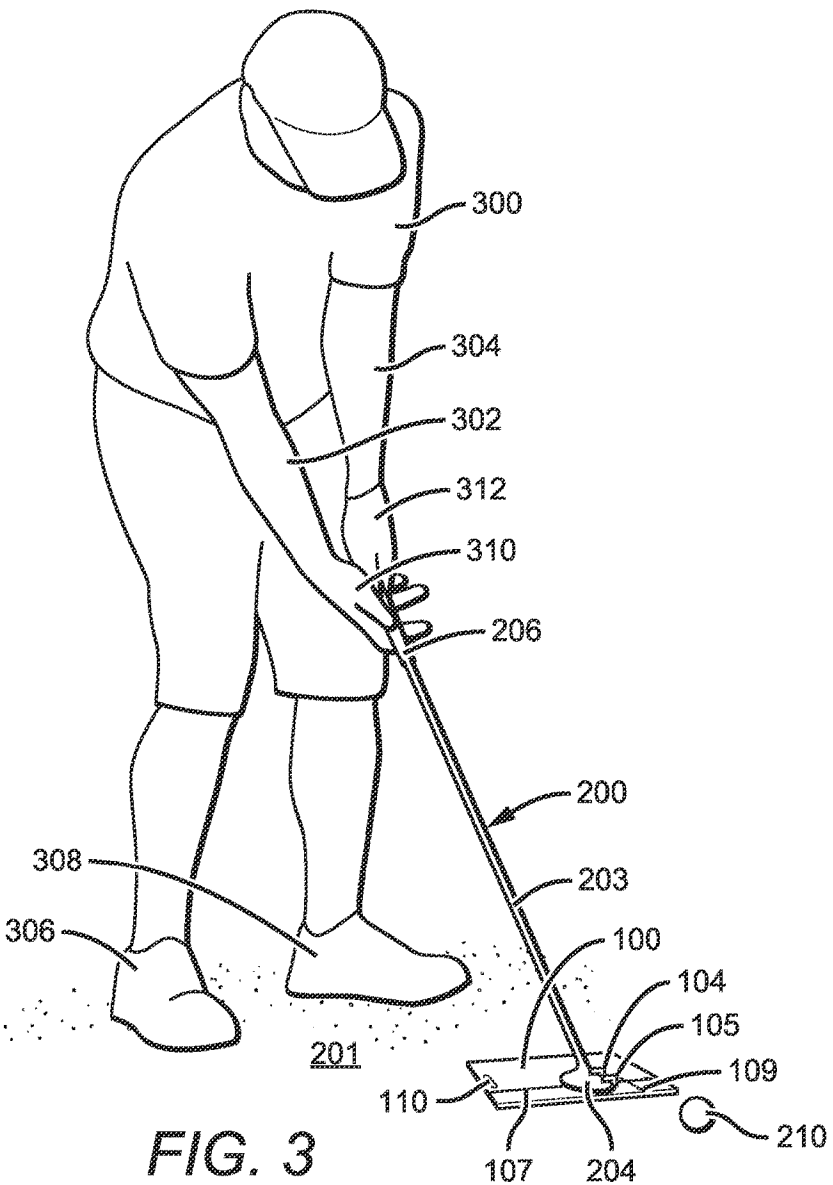
FIG. 3 is a perspective view of a user practicing holding the golf wedge club in a desirable angled alignment while it is retained in the training device as shown in FIG. 2 in accordance with an embodiment of the present invention.

As illustrated, training device 100 has a base 102 with a front 102*a*, a back 102*b*, a first side 102*c*, and a second side 102*d* opposite the first side 102*c*. As can be seen in FIGS. 3 and 4, a user using training device 100 stands adjacent second side 102*d* and somewhat backward beyond the back 102*b* of base 102. For ease of reference herein, first side 102*c* may be considered the "right side" and second side 102*d* may be considered the "left side" of base 102. In embodiments, base 102 may be substantially square-shaped and may be, for example, approximately 10 inches long on each side. Alternatively, in embodiments, base 102 may be shaped differently, such as in a rectangular shape. If rectangular, base 102 may be, for example, approximately 10 inches long and 8 inches wide.

In embodiments, each of the front 102*a*, back 102*b*, and first and second sides 102*c*, 102*d* has approximately the same thickness. The thickness may be generally uniform and may have a thickness within a range of 0.25 to 0.75 inches. More preferably, the thickness may be selected to be approximately 0.5 inches.

There are one or more retaining elements on an upper surface of base 102. These retaining elements are to be used to retain a head of a golf club, as shown in FIG. 2. In the illustrated embodiment, there are two retaining elements 104, 105 on the upper surface of base 102. Retaining elements 104, 105 may be formed integrally with base 102 or be otherwise connected thereto, such as being mounted or affixed to or base 102. Retaining elements are positioned generally toward the front 102*a* of training device 100 and closer to first side 102*c* away from a centerline of training device 100 midway between the first and second sides 102*c*, 102*d*.

In embodiments, the front of retaining elements 104, 105 are both positioned a distance x of approximately 3 inches away from the front 102*a* of training device 100, retaining element 104 is positioned approximately one inch from side 102*c* of training device, and retaining elements 104, 105 are positioned along a direction from one to the other that is transverse to a desired direction of a practice golf swing with a distance y of approximately 1.75 inches between retaining elements 104, 105.

In embodiments, retaining elements 104, 105 are L-shaped structures that are oriented sideways with the lower part of the "L" shape positioned vertically and the top of the L-shape facing backward. In embodiments, the vertical distance between the base of the training device and an underside of a portion of the one or more L-shaped structures that extend substantially parallel to the base is between approximately 0.5 and 0.8 inches. More preferably, the vertical distance between the base of the training device and an underside of portion of the one or more L-shaped structures that extend substantially parallel to the base is approximately ⅝ of an inch.

Training device 100 also includes on its upper surface of base 102 one or more indicia 107 to indicate to a user a suggested direction in which to direct the golf swing when practicing the desired golf shot, such as the sand shot or the flop shot. An example of indicia 107 is shown in FIG. 1 as a line with a forward-pointing arrow drawn from back 102*b* to front 102*a* of base 102. Indicia 107 may be, for example, located somewhere between 2 to 3 inches from first side 102*c* of base 102. To enhance a user's ability to readily see first indicia 107, regardless of whether the user is practicing on a sunny or overcast day, first indicia 107 may be made of a reflective material and may have a color that is easily visible by the user. For example, if base 102 has a relatively dark color, first indicia may be a brighter color that contrasts with the base, such as a bright yellow. On the other hand, if base 102 has a relatively bright color, a darker color may be chosen for first indicia to provide a contrast.

In embodiments, training device 100 may further include one or more second indicia 109 on the upper surface of base 102 to point to an optimal location adjacent first side 102*c* at which to place a golf ball to be used during the user's practice of wedge shots. In embodiments, second indicia 109 may be a line that runs perpendicular to the line of first indicia 107 in front of retaining elements 104, 105 and with an arrow pointing to first side 102*c*. The line of second indicia 109 need not extend the full width of base 102. It could be just several inches long, e.g., 3 inches. In embodiments, the line of indicia 109 may be spaced approximately an inch or two from the front of the retaining elements such that when the wedge is removed by a user from retaining elements 104, 105 for a practice shot the head of the golf club will be in a desired position to address the golf ball. As with the first indicia, the second indicia 109 may be reflective and have an easily visible color to be readily visible whether sunny or overcast outside on the golf course. It may be advisable to use different colors for first and second indicia 107, 109 (such as white for second indicia 109) so that the indicia can be readily distinguished.

Training device 100 may be portable so that it may be carried from one location to another by the user who is using training device 100 for practice. In embodiments, training device 100 may have an optional cutout 110 in base 102 or some other type of handle coupled to base 102 to hold training device 100 thereby as necessary. In an exemplary embodiment, cutout 110 may be located near the back 102*b* of base 102.

Base 102 may be formed of any suitable material, such as a metal sheet, a hard plastic, such as polypropylene, or rubber. When using plastic or rubber material, it is preferable that the material be somewhat malleable so that training device 102 is not too rigid and does not break when in use. Preferably, retaining elements 104, 105 may be formed with the base such as by injection molding so as to be a single piece including base 102 and retaining elements 104, 105. Alternatively, retaining elements 104, 105 may be mounted to the base, such as with a strong adhesive or screws. First and second indicia 107, 109 may be applied to the upper surface of base 102, for example, by applying reflective strips, by painting them, or by another any method.

FIG. 2 shows training device 100 laid down on a surface with the front of the head 204 of a wedge 200 inserted partially under retaining clips 104, 105 on training device 100. The user selects the particular surface on which to lay training device 100 depending upon the shot to be practiced. In embodiments, training device 100 is laid on top of a sand trap 201 on a golf course. The sand trap may be a greenside sand trap, i.e., a sand trap that is relatively close to (e.g., several yards from) the edge of the sand trap adjacent a green. This is because while the golf ball travels high when a wedge is used, the golf ball will only travel a limited maximum distance, e.g., 20 to 30 yards. In another embodiment, base 102 of training device 100 is configured to be laid in rough near a green, i.e., in an area of uncut vegetation, and the one or more specific wedge shots is a flop shot from the rough to return the golf ball to the green.

In the example of FIGS. 2 to 4, the surface on which training device 100 is laid is on a sand trap (bunker) 201 that is near a green 202. The training device 100 is thus positioned to practice performing a sand shot to hit the golf ball out of the sand trap 201 and back onto the green 202. Wedge 200 includes a shaft 203, a head 204, and a grip 206. The head 204 of the golf club includes a heel 205*a* closest to the shaft and a toe 205*b* at the other end of head 204. The head 204 of wedge 200 may be placed into training device 100 by the user or by someone else where it is releasably retained by retaining elements 104, 105. As shown in FIGS. 2 and 5, the underside of each of retaining elements 104, 105 retains a top of head 204 and the upper surface of base 102 grips the bottom (sole) of head 204. Training device 100 thus holds the wedge with shaft 203 angled somewhat toward the back of base 102.

The angle at which shaft 203 is held may depend on the height and shape of retaining elements 104, 105 as well as the shape of head 204. In some embodiments, the one or more retaining elements 104, 105 of the training device are configured to retain the head of wedge 200 such that the shaft 203 of wedge 200 is at an angle of between 10 to 45 degrees leaning backward from a vertical position. This promotes the appropriate amount of "bounce" of head 204 off of sand, in the case of a bunker shot, or rough in the case of a flop shot. "Bounce" generally refers to the extent to which the wedge head splashes through the sand without digging in too deeply, which would excessively retard the club's movement through the sand. In using training device 200, a user should attempt to keep holding the wedge in this angled alignment to take the desired practice shots. To practice using wedge 200 with training device 100, a golf ball 210 is placed in proximity to the right side 102*c* of base 102, e.g., within approximately 4 to 8 inches from the right side 102*c* of base 102, and more preferably approximately 6 inches from the right side 102*c* of base 102, at a position that is aligned with second indicia 109, which is shown as an arrow.

A method of using training device 100 in accordance with embodiments of the present invention is shown with reference to FIGS. 3 and 4 where a user 300 is pictured utilizing training device 100. First, the training device is placed on a surface, as discussed above, with reference to FIG. 2. Also, as shown in FIG. 2, the wedge 200 is inserted under retaining elements 104, 105 by the user or someone else. Next, as shown in FIG. 3, the user 300 assumes a stance as shown whereby the user 300 reaches down with arms 302, 304 and hands 310, 312 as shown to hold grip 206 on wedge 200 while the body of the user is positioned to the left side and possibly somewhat rearward of training device 100. No particular stance is required by this method. However, in this nonlimiting example of a possible stance for a user, it is advisable that the user's right foot 306 be angled slightly toward the front of training device 100 while the user's left foot 308 be turned toward the front of training device 100. The angle of wedge 200 helps position the user in a desired stance. (A left-handed user of a left-handed version of training device 100 could take a stance that is the mirror image of the stance pictured in FIGS. 3 and 4.)

Next, the user 300 may remove the wedge 200 from retaining elements 104, 105 where the head 204 of wedge 200 is positioned in a first position by holding on grip 206 and slipping head 204 of wedge 200 out from under retaining elements 104, 105. Referring to FIG. 4, after removing wedge 200 from retaining elements 104, 105, the user 300 shifts wedge 200 such that the head 204 of wedge 200 is moved to a second position adjacent the right side of training device 100. In moving wedge head 204 from the first position of FIG. 3 to the second position of FIG. 4, the user 300 should attempt to retain the same angled alignment of shaft 203 as was achieved while wedge 200 was held by retaining elements 104, 105 in training device 100. This movement of wedge 200 requires the user to focus and train his or her eyes and body to maintain the angled alignment when wedge 200 is moved.

The desired second position is adjacent but away from retaining elements 104, 105 to allow the user to maintain the desired stance and position the center of wedge head 204, midway between heel 205*a* and toe 205*b* behind golf ball 210 to address golf ball 210 which is in proximity to second indicia 109. Once the user and golf ball 210 are positioned correctly, the user 300 may initiate swinging wedge 200 and practice hitting golf ball 210. In swinging wedge 200, the user 300 should swing wedge 200 approximately in a line parallel to first indicia 107.

As will be understood, the user 300 swings wedge 200 backwards and then forward to attempt to drive golf ball 210 out of sand trap 201. Wedge 200 needs to splash through the sand, in a sand trap, or through the vegetation in a rough near a green with sufficient speed to cause the ball to lift with significant arc onto the green. By practicing with training device 100, as configured, the user will eventually get comfortable addressing the ball with a wedge for sand shots and flop shots.

While FIGS. 3 and 4 describe the user of training device 100 practicing a sand shot, it is contemplated that training device 200 may be used to practice other golf shots with a wedge 200. Thus, for example, this same method described with reference to FIGS. 3 and 4 may be used to practice using a wedge for other shots such as a flop shot by laying training device 100 in rough near a green to practice returning golf ball 210 to the green.

The illustrated embodiment of training device 100 is for use by right-handed players. However, the same type of training device may also be provided for use by left-handed players by providing a training device that is the mirror image of training device 100 with the retaining elements 104, 105, and indicia 107, 109 moved to the other side of the base 102. To use a left-handed version of training device 100, a left-handed player would stand on side 102*c* of base 102 and the golf ball would be placed in proximity to side 102*d* from the perspective of FIG. 1.

FIG. 5 shows a side view of wedge 200. As noted above, different types of wedges may be used with training device 100. Wedges such a sand wedge, lob wedge, and gap wedge may be used. The illustrated embodiment of FIG. 5 shows a wedge 200 that is a sand wedge. Wedge 200 has a loft of angle $\theta_1$ where $\theta_1$ is the inner angle between the upward facing surface of wedge head 204 and shaft 203. The present invention may be particularly useful for wedges that are lofted within the range of 53 to 64, and more preferably within the range of 56 to 64. As shown in the figure, the head 204 of wedge 200 is retained by the bottom of retaining element 105 (and retaining element 104 not visible) and the concave shape of the front of the sole (bottom of head 204) is retained by the base 102. The illustrated wedge head 204 still has clearance between the back of the wedge head 204 and base 102.

FIG. 6 shows another embodiment of a training device 600, similar to training device 100, except that a single retaining element 604 is used in place of two retaining elements 104, 105 in the embodiment of training device 100 shown in FIG. 1. In this example, retaining element 604 may be L-shaped (in other embodiments, it could be some other shape) and may be transparent so that the first indicia 607 and the wedge 200 are visible when retained therein so that the user sees the indicia and wedge when training with training device 600. The embodiment of FIG. 6 may still optionally include a cutout 610, like cutout 110, and may include a second indicia 609 to guide a user where to place golf ball 210 in proximity to training device 600 when used for practice.

Although not illustrated, the present invention provides for one or more retaining elements to be used so that more than two retaining elements may be used rather than just one or two retaining elements. Also, the invention is not limited to the placement of the one or more retaining elements in the illustrated locations or to the particular shape of the retaining elements.

In this regard, FIG. 7 illustrates a side view of wedge 200 retained in a training device 700 with a side view similar to FIG. 5. However, in the illustrated embodiment in FIG. 7, one or more J-shaped retaining elements (e.g., a hook shape) 701 is used in place of one or more L-shaped retaining elements. In one embodiment, two of these J-shaped hooks may be substituted for retaining elements 104, 105. When retaining elements such as 701 are used, the sole of wedge head 204 is still held on the bottom by base 702 of training device 700. However, the top of head 204 is held by the bottom surface of J-shaped retaining element(s). Like in the embodiments described earlier, in this embodiment also, an underside of a portion of the one or more J-shaped structures that extend substantially parallel to the base may be between approximately 0.5 and 0.8 inches, or more preferably, approximately ⅝ of an inch.

The foregoing specification is to be understood as being in every respect illustrative and exemplary, but not restrictive, and the scope of the invention disclosed herein is not to be determined from the specification, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

What is claimed is:

1. A training device for use in training a user to correctly address a golf ball for one or more particular types of wedge shots, the training device, in combination with a golf wedge club, comprising:

a golf wedge club, referred to herein as a wedge;

a base of the training device having a front and a back; and one or more retaining elements on an upper surface of the base that are configured to releasably retain a head of the wedge in a first position whereby a shaft of the wedge is tilted back from a vertical position toward the back of the base with an angled alignment to demonstrate to the user an approximate optimal angle at which the user should hold the wedge when initiating a golf swing for one or more specific types of wedge shots, and to enable removal of the wedge from the one or more retaining elements to allow the user to maintain the angled alignment of the shaft of the wedge after removal of the wedge from the one or more retaining elements to allow the user to practice addressing the golf ball adjacent to the base of the training device; wherein the one or more retaining elements comprise at least one L-shaped structure including a first portion extending upwards from the base and a second portion extending perpendicular to the first portion with an underside of the second portion being a vertical distance in a range of 0.5-0.8 inches directly above a portion of an upper surface of the base such that when the wedge is placed with a sole of the wedge contacting the portion of the upper surface of the base, the underside of the second portion of the L-shaped structure engages the wedge head and is sufficiently rigid such that the wedge is retained in the first position.

2. The training device of claim 1, further comprising one or more indicia on or coupled to the upper surface of the base that are configured to guide the user to position the training device toward a target location on the golf course.

3. The training device of claim 2, wherein the one or more indicia comprises a line drawn on the top of the base.

4. The training device of claim 3, wherein the one or more retaining elements comprises at least two retaining elements, and wherein the line is drawn between the at least two retaining elements.

5. The training device of claim 1, wherein the base of the training device is configured to be laid in a sand trap and the one or more specific wedge shots comprise a sand wedge shot from a sand trap.

6. The training device of claim 1 wherein the base of the training device is configured to be laid in rough near a green and the one or more specific wedge shots comprise a flop shot from the rough.

7. The training device of claim 1, wherein the one or more retaining elements of the training device are configured to retain the head of one of a sand wedge, a lob wedge, or a gap wedge.

8. The training device of claim 1, wherein the one or more retaining elements on the upper surface of the base and configured to releasably retain the head of the wedge while maintaining a sole of the wedge in contact with the base.

9. The training device of claim 1, wherein the one or more retaining elements comprises at least two retaining elements positioned along a direction from one to the other that is transverse to a desired direction of a practice golf swing.

10. The training device of claim 1, wherein the one or more retaining elements are located away from a centerline of the base.

11. The training device of claim 1 wherein the one or more retaining elements are configured to retain the head of the wedge such that the shaft of the wedge is at an angle of between 10 to 45 degrees leaning backward from a vertical position.

12. The training device of claim 1, wherein the base comprises one of a metal sheet, plastic, or rubber.

13. The training device of claim 1, wherein the base is square-shaped.

* * * * *